US005249802A

United States Patent [19]

McCarthy

[11] Patent Number: 5,249,802

[45] Date of Patent: Oct. 5, 1993

[54] BOXES FOR STORAGE FORMING A WALL PUZZLE

[76] Inventor: Anthony J. McCarthy, 36 Carver St., New Britain, Conn. 06053

[21] Appl. No.: 484,053

[22] Filed: Feb. 23, 1990

[51] Int. Cl.[5] ..... A63F 9/08; B65D 85/00

[52] U.S. Cl. ..... 273/157 R; 273/DIG. 30; 206/315.1; 206/457

[58] Field of Search ..... 273/153 R, 157 R, 160, 273/DIG. 30, 148 R; 40/605, 908; 428/47, 48, 50, 100, 913.3; 434/172, 429, 430; 206/579, 315.1, 806, 457, 459, 44 R; 52/DIG. 13, 506

[56] References Cited

U.S. PATENT DOCUMENTS

| | | | |
|---|---|---|---|
| 557,307 | 3/1896 | Foster | 434/172 |
| 1,189,598 | 7/1916 | McLean | 273/157 R |
| 1,339,251 | 5/1920 | Yonemoto | 273/157 R |
| 1,542,031 | 6/1925 | Bruhn | 434/172 |
| 2,130,762 | 9/1938 | Borden | 206/459 X |
| 3,181,869 | 5/1965 | Genin et al. | 273/157 R |
| 3,815,808 | 6/1974 | Bunnell | 206/459 X |
| 4,177,305 | 12/1979 | Feingold et al. | 273/157 R X |
| 4,345,762 | 8/1982 | Lebelson | 273/157 R |
| 4,486,018 | 12/1984 | Keller, Jr. | 273/157 R |
| 4,687,202 | 8/1987 | Palma | 273/157 R |
| 4,741,534 | 5/1988 | Rogahn | 273/157 R |
| 4,744,189 | 5/1988 | Wilson | 40/908 X |
| 4,816,302 | 3/1989 | Shaw . | |
| 4,984,798 | 1/1991 | Silberstein | 273/157 R |

FOREIGN PATENT DOCUMENTS

| | | | |
|---|---|---|---|
| 2309584 | 1/1984 | Australia | 273/157 R |
| 19751 | 4/1929 | Netherlands | 273/157 R |
| 675678 | 7/1952 | United Kingdom | 273/157 R |
| 2166581 | 5/1986 | United Kingdom | 273/157 R |

*Primary Examiner*—V. Millin
*Assistant Examiner*—Sebastiano Passaniti
*Attorney, Agent, or Firm*—Anne M. Rosenblum

[57] ABSTRACT

A decorative receptacle for storing pieces of an unassembled puzzle on a wall which has a top portion and a cooperatively interfitting bottom portion in a spaced-apart relation; the top portion having a flat surface and four upright sides defining a downwardly opening recess; the bottom portion having a flat surface and four upright sides defining an upwardly opening recess whereby the sides of the bottom portion cooperatively fit within the sides of the top portion, keeping the bottom portion and the top portion in a spaced-apart relation and defining a hollow space of predetermined height, length and width for storing pieces of an unassembled puzzle therein. The top portion is attached to the wall and the bottom portion carries the decorative display surface that faces outward from the wall.

7 Claims, 3 Drawing Sheets

BOXES FOR STORAGE FORMING A WALL PUZZLE

BACKGROUND OF THE INVENTION

1. Field of the Invention

This invention relates to a novel wall puzzle which is comprised of a plurality of receptacles for storing unassembled puzzle pieces. The invention further concerns a decorative means for storing pieces of unassembled puzzles on a wall.

2. Description of Related Art

Various ways to display a completed puzzle have been described in the art. For example, U.S. Pat. No. 4,687,202 illustrates a combination puzzle, box and hangable puzzle frame. The box has a transparent top for viewing an enclosed, assembled puzzle and a perforated bottom wall for hanging the display enclosure. U.S. Pat. No. 4,177,305 discloses a wall hanging that provides a variable ornamental picture made of numerous interchangeable tiles which snap-fit onto a decorative wall hung frame. U.S. Pat. No. 3,181,869 shows a magnetic puzzle plaque which can be suspended from a wall. The puzzle pieces have magnets to be fixed upon a sheet metal backing. U.S. Pat. No. 4,816,302 concerns a decorative art work that may be mounted on a wall wherein the wall hanging comprises a plurality of interlocked puzzle pieces with at least one puzzle piece left out of the matrix.

The typical decorative wall hanging involves mounting the assembled puzzle itself on the wall. The puzzles comprise the graphic display. However, no art specifically discloses creating a unique wall design or puzzle out of a box or a plurality of boxes which are useful for the storage of unassembled puzzle pieces.

SUMMARY OF THE INVENTION

It is therefore an important object of the present invention to provide an improved wall design or puzzle comprising a box or a plurality of boxes which function as a storage compartment for puzzle pieces.

Another object is to provide a multipurpose box useful for storing unassembled puzzle pieces while concurrently forming a piece of a different puzzle which is fastened to a wall.

A further object is to provide a series of related puzzles having the same theme as the wall puzzle which will be challenging and educational to the consumer regarding the subject matter of the series.

Further purposes and objects of the present invention will appear as the specification proceeds.

With the foregoing and other objects in view, the invention herein provides a wall design or puzzle comprising one box or more than one closely-spaced boxes having a particular graphic representation or pictorial subject on the bottom of the box wherein the box also serves as storage compartments for unassembled pieces of different puzzle designs.

BRIEF DESCRIPTION OF THE DRAWINGS

Referring to the accompanying drawings, the present invention is illustrated, wherein.

DETAILED DESCRIPTION OF THE INVENTION

The present invention particularly concerns a unique wall puzzle comprising two or more boxes which are arranged on the wall to create a particular design, insignia or popular name and may contain unassembled pieces of various puzzles. Depending upon the picture or name to be completed, the boxes can be horizontally positioned in a contiguous pattern or can leave a space between groups of boxes. Also contingent upon the specific design, it is contemplated that this invention includes the use of the boxes fastened to the wall in any position, for example, a vertical arrangement or perhaps stacked rows, being placed both vertical and horizontal to one another. The present invention further includes the use of one box as a decorative means for storing pieces of an unassembled puzzle on a wall.

Figure 1:
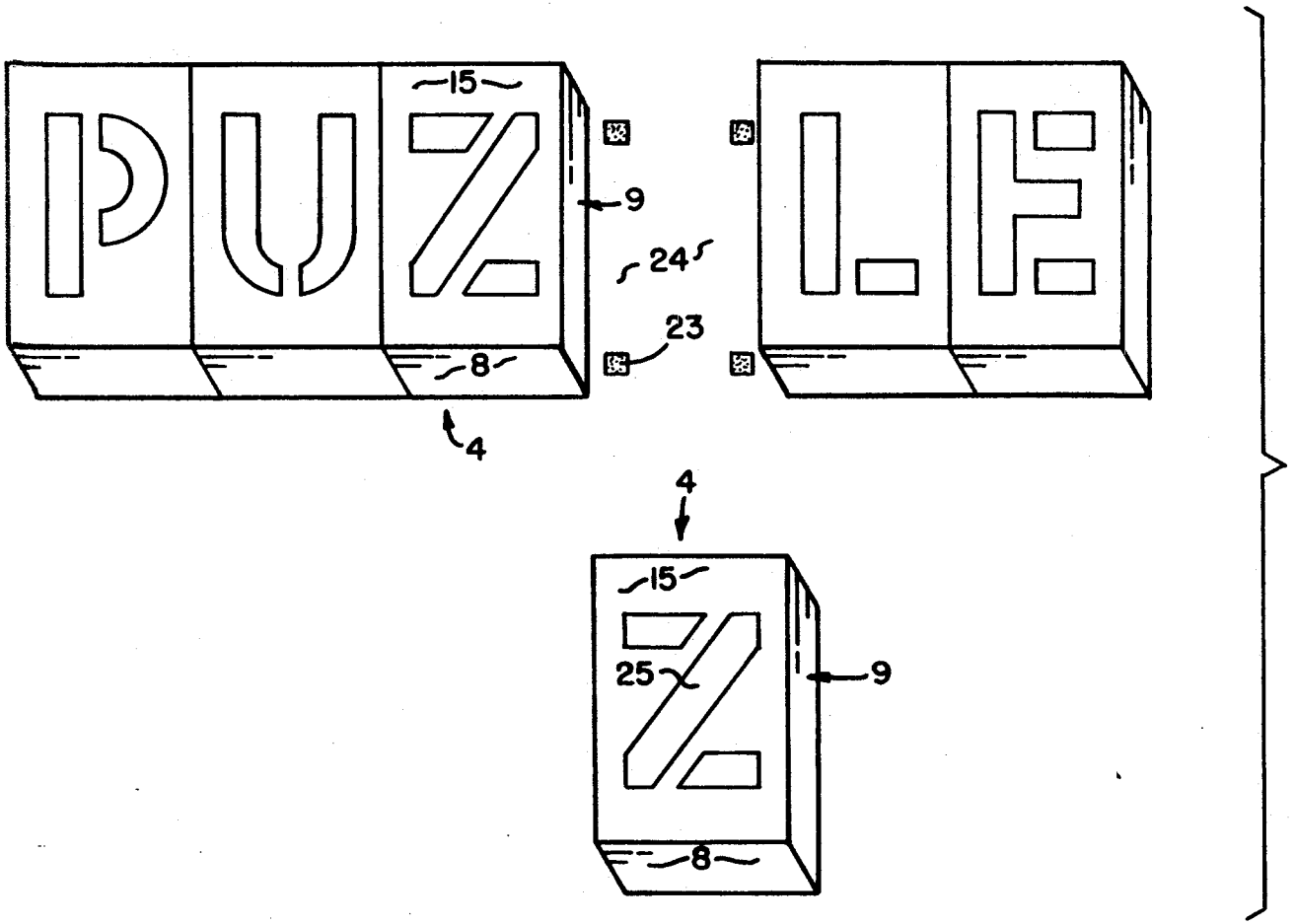
FIG. 1 is a perspective view of the placement of individual boxes to create a wall puzzle.

With reference to the accompanying drawings, FIG. 1 illustrates creating a wall puzzle by the horizontal placement of individual boxes 4 upon the wall 24.

Figure 2:
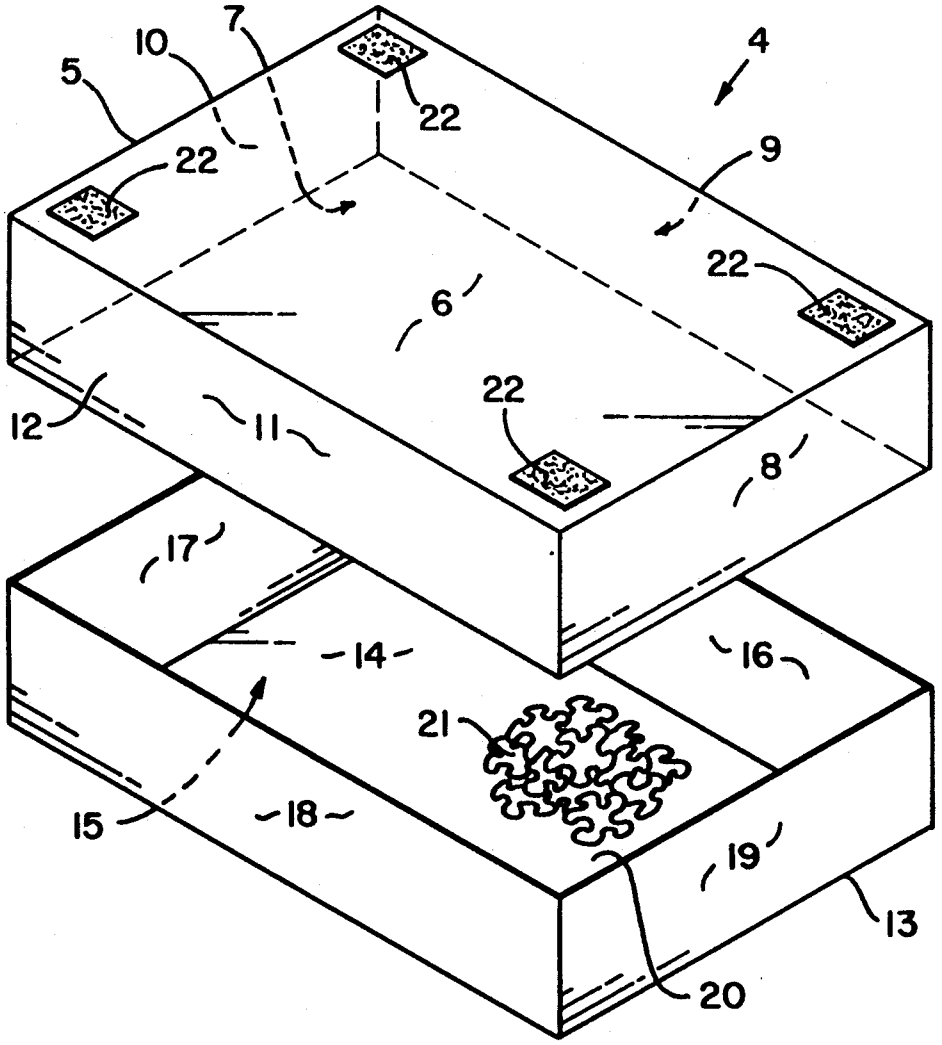
FIG. 2 is a top view of a single, open box showing the storage compartment and the means for fastening the box to the wall.

Each box 4 is a typical receptacle for holding unassembled jigsaw puzzle pieces. The box can be made out of any conventional material. However, it is appreciated that the box should be fairly light-weight. Generally, as illustrated in FIG. 2, the box 4 has a top portion 5 including a flat, outer surface 6, a flat, inner surface 7 and four upright sides 8, 9, 10, 11 with a downwardly opening recess 12. The bottom portion 13 of the box, of course, has a flat, inner surface 14, a flat, outer surface 15 and four upright sides 16, 17, 18, 19 with an upwardly opening recess 20, wherein the sides of the bottom portion usually cooperatively fit within the top portion, keeping the bottom and top portions in a spaced-apart relation and defining a hollow space of predetermined height, length and width for a storage compartment for unassembled puzzle pieces 21. A typical size can be, for example, around 12"×9½"×2", but larger and smaller sizes can find use in the present invention.

Figure 3:
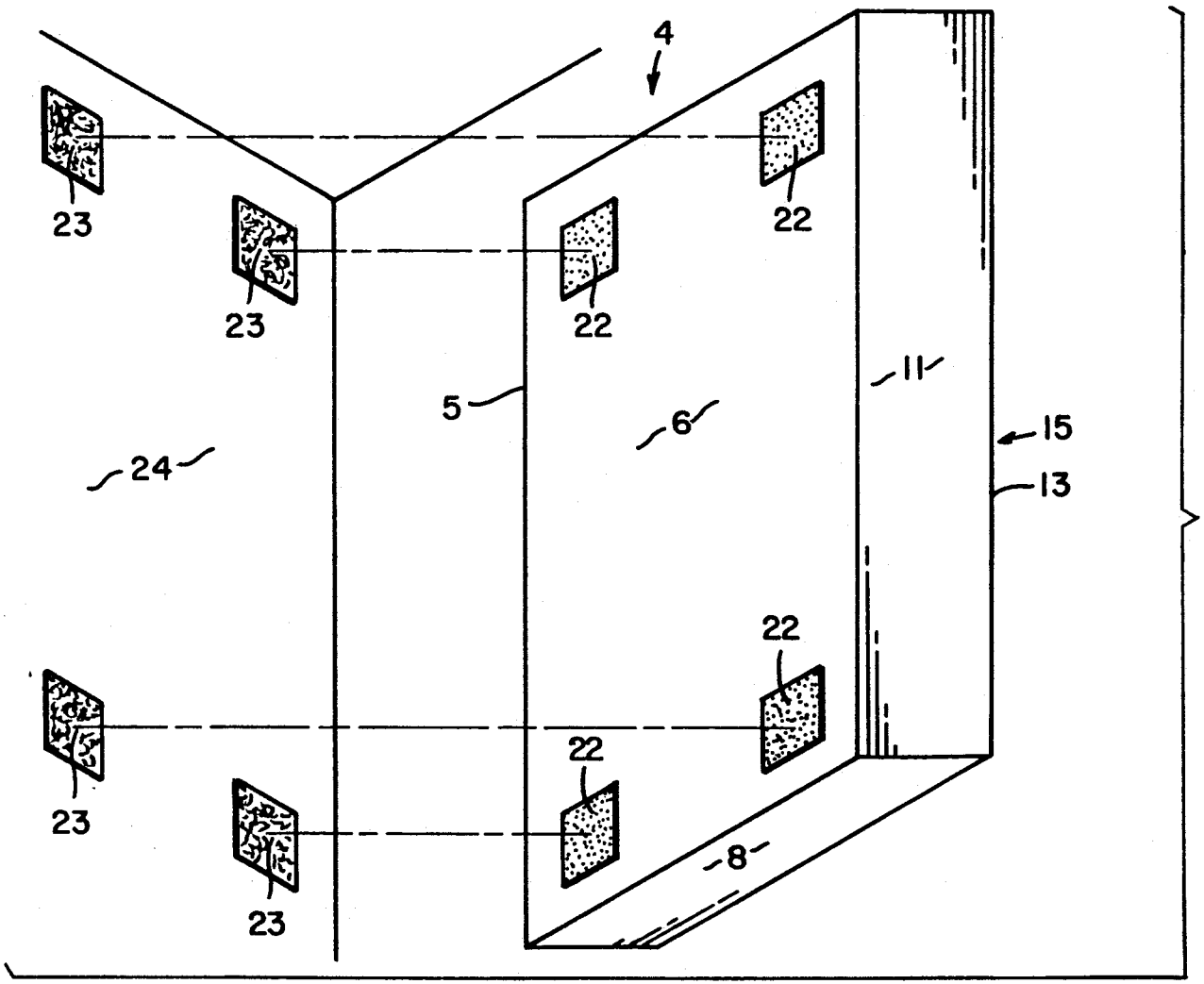
FIG. 3 is a side view of the top of a single, closed box being attached to the wall.

Generally, the top 5 of the box will be fastened to the wall and the bottom portion 13 will carry the graphic representation or pictorial subject as a decorative display which will face outward from the wall, on the flat, outer surface 15. Means for attaching 22 the top portion 5 desirably are positioned near each of the four corners of the flat, outer surface 6 of the top. Use of a nail or a tack which would perforate the box is not convenient means for attachment. Preferably, the fastening means stick to the surface of both the box and the wall providing a temporary adhesion between the two surfaces and allowing for fast, safe and easy attachment and removal of the box from the wall. It is readily appreciated that the box is not permanently affixed to the wall but can be easily and quickly removed in order to put in or take out the puzzle pieces. Also, the benefit to nonpermanent attachment lends the design to becoming variable, if desired. FIG. 3 exemplifies using VELCRO ® (a registered trademark of Velcro U.S.A. Inc., Manchester, N.H.) as the means for fastening 22 the boxes 4 to the fastening mate 23 on the wall 24. Any equivalent product to achieve the temporary adhesion between the two surfaces will suffice, such as, for example, double-sided adhesive tape. The VELCRO ® or other means can be permanently or temporarily attached to the wall and/or the top of each box.

As exemplified in FIG. 1, the boxes can be arranged on the wall to spell a word 25 or a name such as a popular singer, band player, music group and the like. Usually, the bottom of each box displays a different portion of the desired graphic representation or pictorial subject on a decorative display surface. Then a plurality of boxes can be positioned on the wall in a spaced-apart relationship to complete the word, name or picture. A "plurality" of boxes is defined as more than one receptacle. Although the designs on the boxes and their contents can be unrelated, it is contemplated that the boxes will create a wall puzzle of the same theme as the jigsaw puzzles stored within each box. In particular, it is further contemplated that the several related puzzles will be able to combine the skill and fun of assembling puzzles with music education. For instance, the jigsaw puzzles can be designs from various record albums or discs of a particular rock group or jazz band and the wall puzzle can be the band name or a special insignia thereof. It can be additionally educational to include with each box an insert which contains descriptive and historical information pertaining to the subject of the puzzle such as the discography, quotes or other career highlights of the group. The insert can be creatively designed in the shape of a disc or record with a 6" diameter and made from about 100 lb. to about 120 lb. index stock.

The concept of the present invention is unique in that it can use puzzles in a series rather than individually. The novel packaging of the jigsaw puzzle serves the dual purpose of use as a storage box and yet part of another wall puzzle. In this fashion, the consumer can enjoy the creativity, challenge and longevity of each puzzle with the uniqueness and dual functionality of the package. Furthermore, if the puzzle is completed, the novel concept of this invention gives an additional benefit in providing a decorative and clean way for storing and saving the empty box itself.

In the foregoing there has been provided a detailed description of preferred embodiments of the present invention for the purpose of illustration and not limitation. It is to be understood that all other modifications, ramifications and equivalents obvious to those having skill in the art based on this disclosure are intended to be within the scope of the invention as claimed.

I claim:

1. A decorative means for storing pieces of an unassembled puzzle on a wall comprising: a receptacle having a top portion and a cooperatively interfitting bottom portion in a spaced-apart relation; said top portion having a flat, inner surface, a flat, outer surface and four upright sides defining a downwardly opening recess; said bottom portion having a flat, inner surface, a flat, outer surface and four upright sides defining an upwardly opening recess whereby said sides of said bottom portion cooperatively fit within said sides of said top portion, keeping said bottom portion and said top portion in a spaced-apart relation and defining a hollow space of predetermined height, length and width for storing pieces of an unassembled puzzle therein; said top portion further having on the outer surface, means for attaching said receptacle on a wall and said bottom portion further having a decorative display on the outer surface facing outward from said wall.

2. The decorative means for storing pieces of an unassembled puzzle on a wall according to claim 1, wherein said receptacle comprises a rectangular box or a square box.

3. The decorative means for storing pieces of an unassembled puzzle on a wall according to claim 2, wherein said receptacle further includes unassembled puzzle pieces within the hollow space.

4. A wall puzzle comprising: a plurality of receptacles, each receptacle having a top portion and a cooperatively interfitting bottom portion in a spaced-apart relation; said top portion having a flat, inner surface, a flat, outer surface and four upright sides defining a downwardly opening recess; said bottom portion having a flat, inner surface, a flat, outer surface and four upright sides defining an upwardly opening recess whereby said sides of said bottom portion cooperatively fit within said sides of said top portion keeping said bottom portion and said top portion in a spaced-apart relation and defining a hollow space of predetermined height, length and width for storing pieces of an unassembled puzzle therein; said top portion further having on the outer surface, means for attaching said receptacle on a wall and said bottom portion further having a portion of a graphic representation or pictorial subject as a decorative display on the outer surface facing outward from said wall; each receptacle displaying a different portion of the graphic representation or pictorial subject on the decorative display surface of said bottom portion; whereby said plurality of receptacles are positioned on the wall in a spaced-apart relationship to complete said graphic representation or pictorial subject.

5. The wall puzzle according to claim 4, wherein said receptacles comprise a rectangular box or a square box.

6. The wall puzzle according to claim 5, wherein one receptacle further includes unassembled puzzle pieces within the hollow space.

7. The wall puzzle according to claim 5, wherein said receptacles are arranged on the wall in a horizontal or vertical position in relation to each other.

* * * * *